US005924311A

United States Patent [19]

Matsuda et al.

[11] Patent Number: 5,924,311

[45] Date of Patent: Jul. 20, 1999

[54] METHOD AND APPARATUS FOR MANUFACTURING KNIT SLIDE FASTENER STRINGER

[75] Inventors: Yoshio Matsuda; Shunji Akashi; Hidenobu Kato; Yoshito Ikeguchi, all of Toyama-ken, Japan

[73] Assignee: YKK Corporation, Tokyo, Japan

[21] Appl. No.: 08/907,077

[22] Filed: Aug. 6, 1997

[30] Foreign Application Priority Data

Aug. 8, 1996 [JP] Japan ..... 8-210206

[51] Int. Cl.[6] ..... D04B 23/14

[52] U.S. Cl. ..... 66/85 R; 66/193

[58] Field of Search ..... 66/83, 84 A, 84.2, 66/85 R, 193

[56] References Cited

U.S. PATENT DOCUMENTS

| | | | |
|---|---|---|---|
| 3,523,430 | 8/1970 | Inui | 66/84 A X |
| 3,653,230 | 4/1972 | Tosco | 66/85 R |
| 4,034,579 | 7/1977 | Tilton | 66/85 R |
| 5,452,591 | 9/1995 | King | 66/85 R X |
| 5,653,127 | 8/1997 | Berger et al. | 66/85 R |
| 5,680,777 | 10/1997 | Zorini | 66/85 R X |

FOREIGN PATENT DOCUMENTS

| | | |
|---|---|---|
| 0 385 100 | 9/1990 | European Pat. Off. . |
| 2 188 976 | 1/1974 | France . |
| 30 26 488 A1 | 2/1982 | Germany . |

*Primary Examiner*—John J. Calvert
*Assistant Examiner*—Larry D. Worrell, Jr.
*Attorney, Agent, or Firm*—Hill & Simpson

[57] ABSTRACT

A multiplicity of knitting needles and one or more knitting needles are slid vertically along first and second needle beds, respectively, which are disposed in a back-to-back relationship with and spaced a predetermined distance from each other. The second needle bed extends along only one end portion of the first needle bed. And at the same time, a predetermined number of knitting yarn guides are swung and shogged. During that time, a monofilament bending means disposed near one end of the first needle bed reciprocates along the upper space between the first and second needle beds at an underlapping position to continuously form individual fastener elements by bending the monofilament and to knit the formed fastener elements successively in a warp-knit fastener tape by the back-to-back needles in the first and second needle beds simultaneously with the knitting of the tape.

20 Claims, 6 Drawing Sheets

METHOD AND APPARATUS FOR MANUFACTURING KNIT SLIDE FASTENER STRINGER

BACKGROUND OF THE INVENTION

1. Field of the Invention

This invention relates to a method of and an apparatus for manufacturing a knit slide fastener stringer having a fastener element row which is continuously formed by bending a linear monofilament and is knitted in and along one longitudinal edge of a warp-knit fastener tape simultaneously with the knitting of the tape. More particularly, this invention relates to a method of and an apparatus for manufacturing a knit slide fastener stringer in which a warp-knit fastener tape has a longitudinal of high density edge so that a fastener element row can be knitted in the longitudinal edge stably and firmly, and in which an increased rate of production can be realized.

2. Description of the Related Art

Knit slide fastener stringers of the type in which a coiled fastener element row is knitted in a warp-knit fastener tape simultaneously with the knitting of the tape are already known from, for example, Japanese Patent Laid-Open Publication No. Hei 2-255104 and Italian Patent No. 1118020. Further, apparatus for manufacturing this type of knit slide fastener stringers are disclosed in, for example, the above-mentioned Italian Patent, Japanese Patent Publication No. Sho 48-40034 and Japanese Patent Publication No. Sho 49-42011.

As is described in the above-mentioned publications, in the fundamental structure of this type knit slide fastener stringer, a fastener tape including a fastener-element-row attaching margin is composed of chain-stitches, tricot-stitches and weft-inlaid stitches, and the fastener element row is knitted in and along the fastener-element-row attaching margin of the fastener tape simultaneously with the knitting of the tape in such a manner that each and every leg portion of the individual fastener element is connected with stitches of the foundation structure of the fastener-element-row attaching margin astride of part of loops of anchoring chain-stitch yarns simultaneously with the knitting of the tape. Thus the fastener element row is firmly secured to the foundation structure of the attaching margin of the tape. The anchoring yarns should by no means be limited to chain stitch yarns, but may be an alternative form such as a combination of tricot-stitch yarns and weft-inlaid yarns, or etc. . . .

In the conventional apparatus disclosed in the above-mentioned publications, the monofilament is bent in a coiled form so as to be a coiled fastener element row before introduced into the apparatus, whereupon the fastener element row is introduced continuously to a knitting position of the attaching margin of the tape via a tubular guide member (i.e., a fastener element guide) of the apparatus and is knitted in a predetermined position of the attaching margin of the tape simultaneously with the knitting of the tape.

However, since it is formed of a coiled synthetic resin monofilament, the fastener element row is extremely extendible and contractible and hence non-stable in shape. It is therefore very difficult, from a technical viewpoint, to introduce the individual fastener elements of the fastener element row successively and accurately to the corresponding knitting portions of the fastener-element attaching margin of the tape. Further, as is apparent from the above-mentioned publications, since the conventional apparatus is not equipped with any fastener-element positioning means, it is also difficult to fixedly attach the fastener element row with the head portions of the elements arranged in an uniform pitch and kept in uniform shape. For these reasons, knit slide fasteners of this type have not been on the market for the time being.

SUMMARY OF THE INVENTION

With the foregoing problems in view, it is an object of this invention to provide a method of and an apparatus for efficiently manufacturing a knit slide fastener stringer in which individual fastener elements are stable in shape.

According to a first aspect of the invention, the above-mentioned object is accomplished by a method of manufacturing a knit slide fastener stringer having a fastener element row which is continuously knitted in and along one longitudinal edge of a warp-knit fastener tape simultaneously with the knitting of the fastener tape while the fastener element row is formed by bending a linear synthetic resin monofilament, the method comprising the steps of: sliding a multiplicity of parallel knitting needles vertically in a first needle bed; sliding one or more knitting needles vertically in a second needle bed disposed along one end portion of the first needle bed in a back-to-back relationship, with a predetermined distance from the first needle bed; swinging and shogging a number of knitting yarn guides with respect to the corresponding needles of the first and second needle beds; reciprocating monofilament bending means, which is disposed near one end of the first needle bed, in an upper space between the first and second needle bed longitudinally along the first and second needle beds; and driving the needles, the knitting yarn guides and the monofilament bending means by a driving means at a predetermined timing in synchronism with one another, in which the monofilament bending means reciprocates between the needles of the first and second needle beds at an underlapping position to continuously form individual fastener elements while bending the monofilament and also to knit the fastener elements in the fastener tape by the back-to-back needles of the first and second needle beds simultaneously with the knitting of the fastener tape.

Preferably, the head portion of the individual fastener element is held by a head-portion-holding member to be moved between a head-portion-holding position and a non-head-portion-holding position in synchronism with the bending of the monofilament. Usually, the monofilament bending means takes a single reciprocating movement when the needles in the second needle bed are moved upwardly. But it is preferable that the monofilament bending means takes the reciprocating movement for the stitches of every other courses of the fastener tape.

For manufacturing an ordinary-type knit slide fastener stringer, the head-portion-holding position is disposed at an outer end portion of the second needle bed to form the head portions of the fastener elements along an outer edge of the fastener-element attaching margin of the fastener tape. For manufacturing a concealed-type knit slide fastener stringer, the head-portion-holding position is disposed at a position inside the second needle bed to form the head portions of the fastener elements along an inner edge of the fastener-element attaching margin of the fastener tape at a border with a web portion. The monofilament bending means is retracted to a terminal position of the single reciprocating movement so as not to interfere with and the knitting yarns, so smooth movement of the individual members can be achieved.

According to a second aspect of the invention, the foregoing method is carried out by an apparatus for manufacturing a knit slide fastener stringer having a fastener element row which is continuously knitted in and along one longitudinal edge of a warp-knit fastener tape simultaneously with the knitting of the warp-knit fastener tape while the fastener element row is formed by bending a linear synthetic resin monofilament, the apparatus comprising: a first needle bed for slidably guiding a multiplicity of parallel knitting needles vertically; a second needle bed disposed along one end portion of the first needle bed in a back-to-back relationship, with a predetermined distance from the first needle bed for slidably guiding one or more knitting needles; a number of knitting yarn guides adapted to be swung and shogged with respect to the corresponding needles of the first and second needle beds; a monofilament bending means disposed at a position near one end of the first needle bed for reciprocating movement in an upper space between the first and second needle beds longitudinally along the first and second needle beds; and driving means for synchronously driving the needles, the knitting yarn guides and the monofilament bending means at a predetermined timing, in which the monofilament bending means reciprocates between the needles at an underlapping position to continuously form individual fastener elements by bending the monofilament and also to knit the fastener elements in the fastener tape by the back-to-back needles in the first and second needle beds simultaneously with the knitting of the fastener tape.

Preferably, the apparatus further includes a head-portion-holding member adapted to be moved between a head-portion-holding position and a non-head-portion-holding position in synchronism with the bending of the monofilament. The monofilament bending means takes a single reciprocating movement, when the needles in the second needle bed are moved upwardly, preferably for the stitches of every other courses of the fastener tape. The monofilament bending means is retracted to a terminal position of the single reciprocating movement so as not to interfere with the knitting yarns, so smooth movement of the individual members can be achieved.

If the head-portion-holding member is disposed at an outer end portion of the second needle bed, the head portions of the fastener elements are formed along an outer edge of the fastener-element attaching margin of the fastener tape. Thus an ordinary-type knit slide fastener stringer can be manufactured. If the head-portion-holding member is disposed at a position inside the second needle bed, the head portions of the fastener elements are formed along an inner edge of the fastener-element attaching margin of the fastener tape at a border with a web portion. Thus a concealed-type knit slide fastener stringer can be manufactured.

DETAILED DESCRIPTION OF THE PREFERRED EMBODIMENTS

Various embodiments of a knit slide fastener stringer manufacturing apparatus of this invention will now be described in detail with reference to the accompanying drawings.

Figure 1:
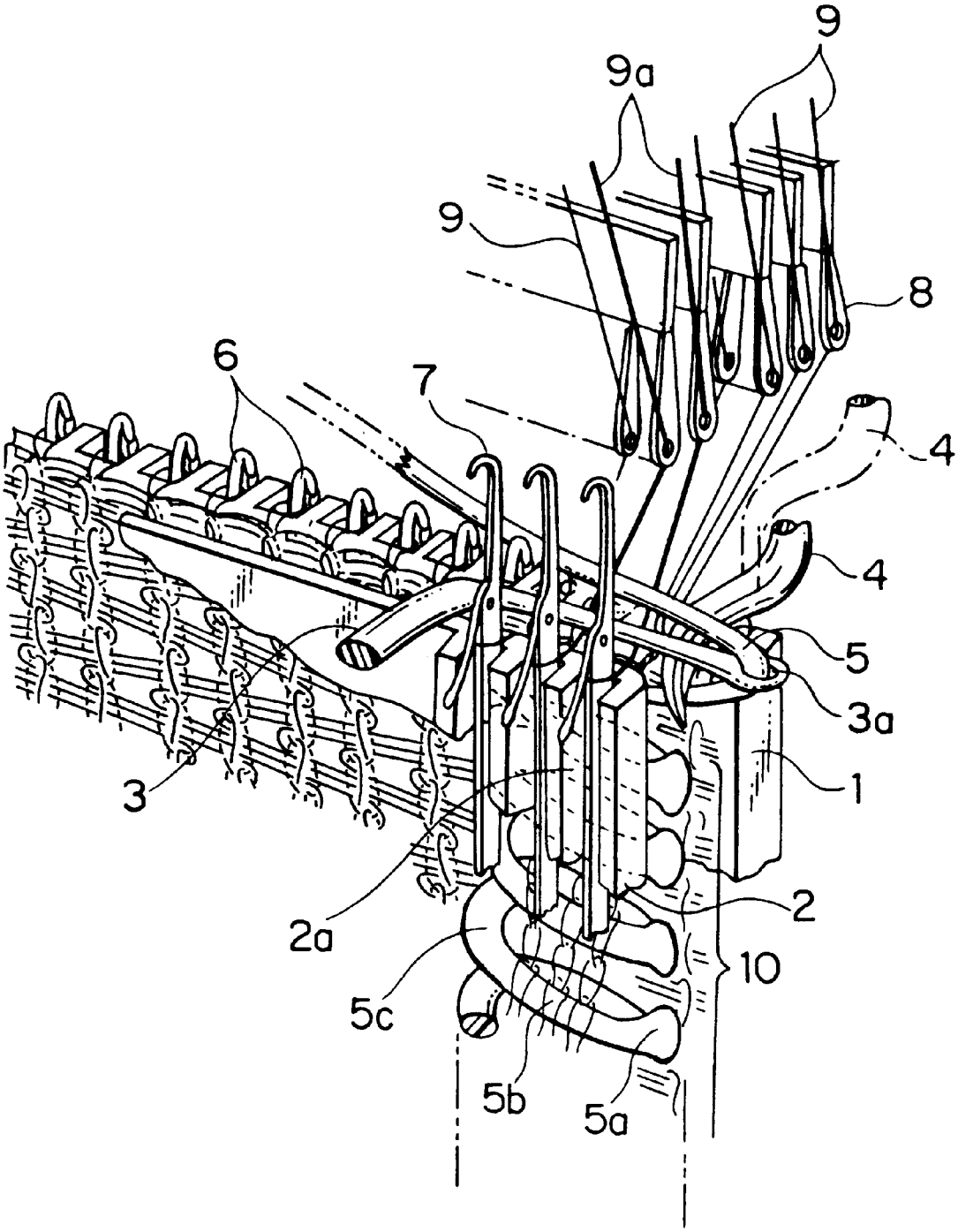
FIG. 1 is a perspective view showing a main portion of a knit slide fastener stringer manufacturing apparatus while a monofilament is being bent according to a first embodiment of this invention.
Figure 2:
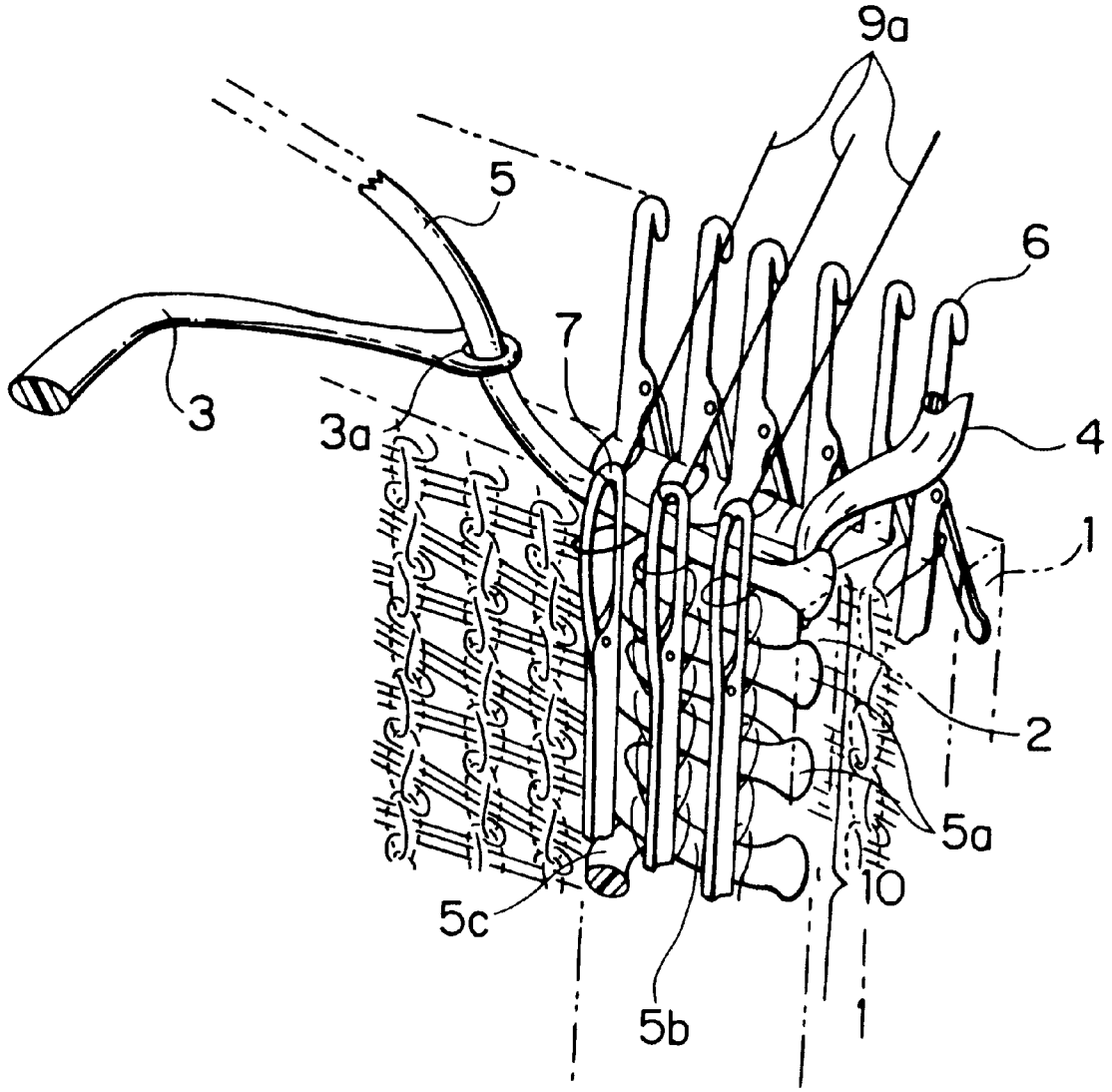
FIG. 2 is a perspective view showing a main portion of the apparatus of the first embodiment when the bending of the monofilament is completed.

FIGS. 1 and 2 are perspective views showing various principal members of a knit slide fastener stringer manufacturing apparatus according to a first embodiment of the invention; FIG. 1 shows the respective positions of the principal members of the apparatus while a monofilament is being bent to form a head portion of a single fastener element, and FIG. 2 shows the respective positions of the same members of the apparatus when the monofilament has been bent to form a head portion of a single fastener element. In this embodiment, an ordinary double Raschel knitting machine is used for the apparatus. Consequently many members of the apparatus are not shown and their detailed description is omitted here.

In FIGS. 1 and 2, reference number 1 designates a first needle bed; 2, a second needle bed; and 3, a monofilament carrier constituting a monofilament bending means as a characteristic part of this invention. 4 designates a head-portion-holding member for holding a head portion from its inner side and positioning a bent position of the head portion during bending of a monofilament 5; 6, back needles; 7, front needles; 8, knitting yarn guides; 9, knitting yarns of a foundation structure of a fastener tape T; 9*a*, anchoring knitting yarns for securing a fastener element row 10. The first needle bed 1, the second needle bed 2, the back needles 6, the front needles 7 and the knitting yarn guides 8 are members which are usual components of a double Rachel machine and not peculiar to this invention.

Figure 5:
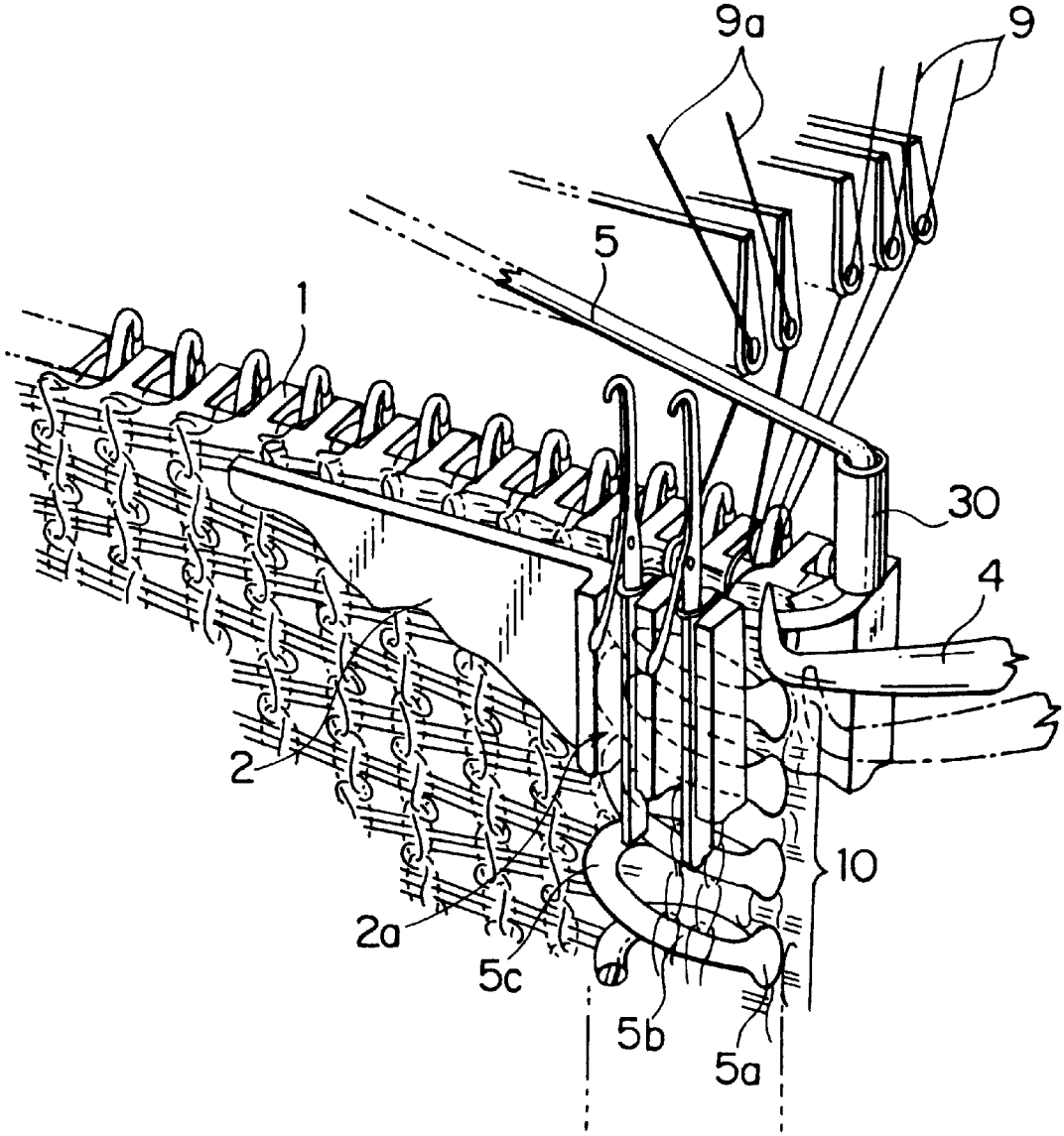
FIG. 5 is a perspective view showing a main portion of a knit slide fastener stringer manufacturing apparatus according to a second embodiment of this invention.

In the first embodiment of FIG. 1 and a second embodiment of FIG. 5, the second needle bed 2 is in the form of a plate having a necessary number of sliding grooves 2*a* only in a marginal region at one end of a longitudinal direction thereof, leaving the remaining region mere flat. In a third embodiment of FIG. 6, a second needle bed 2 is in the form of a plate of a small width having a necessary number of sliding grooves 2*a*, thus forming no groove-free region.

Figure 3:
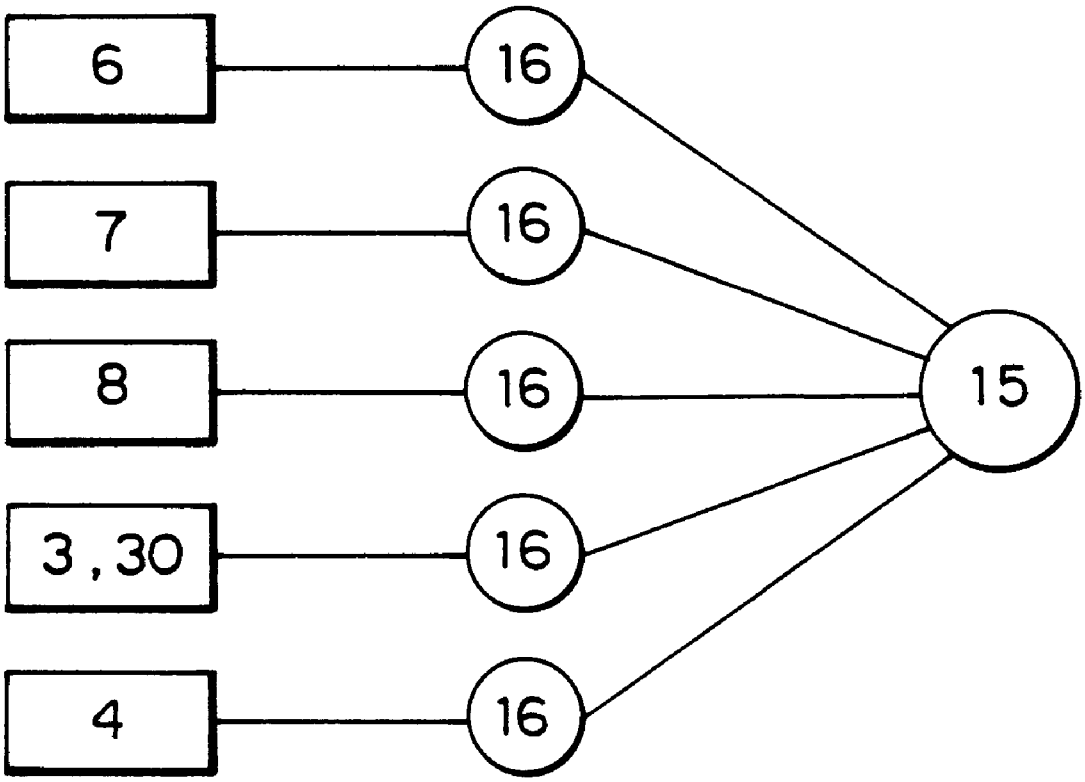
FIG. 3 is a diagram showing a mechanism of driving the individual members of the apparatus of the first embodiment.
Figure 4:
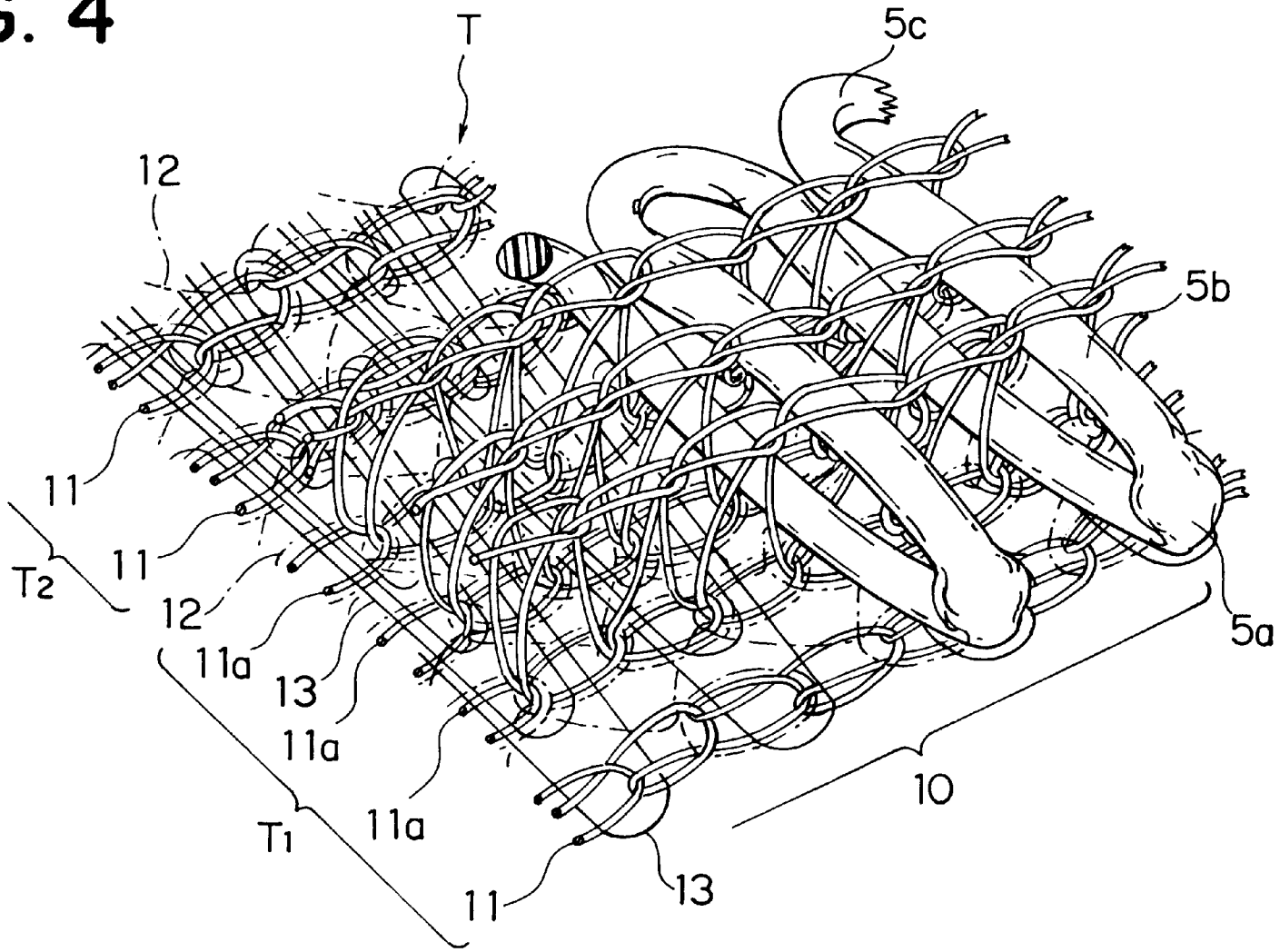
FIG. 4 is a fragmentary perspective view schematically showing a knit structure of a knit slide fastener stringer manufactured by the apparatus of the first embodiment.

The back needles 6 are slidably received respectively in a number of parallel sliding grooves of the first needles bed 1 for knitting the foundation structure of the fastener tape T including the fastener-element attaching margin T1 where a fastener element row 3 10 is fixedly attached and the web portion T2 (FIG. 4). As shown in FIG. 3, the back needles 6 are connected to a drive source 15 via respective synchronous transmission mechanisms 16, such as cams, for being vertically moved independently of one another. The front needles 7 are needles for knitting an anchoring knit structure to knit the fastener element row 10 in the fastener-element attaching margin T1 of the fastener tape T.

Accordingly, the number of the front needles 7 to be used is determined by a number of anchoring knitting yarns 9*a*; in the illustrated apparatus, three front needles 7 are used so as to knit and anchor the fastener element row 10 by three-row anchoring warp-knit structure. If the fastener elements have shorter leg portions in width and if the fastener tape is narrower, only a single front needle 7 may be used. Namely, the number of the front needles 7 may be changed according to the type of a slide fastener to be manufactured. For example, for anchoring the fastener element row 10 by two-row anchoring warp-knit structure, two front needles 7 are used. Alternatively, the anchoring warp-knit structures may be knitted by the back needles 6, while the foundation structure of the fastener tape T may be knitted by the front needles 7.

For lapping the knitting yarns 9, 9*a* over the individual needles 6, 7, a multiplicity of knitting yarn guides 8 are disposed above the first and second needle beds 1, 2 to introduce the knitting yarns 9, 9*a* to the respective needles 6, 7. These knitting guides 8 takes back and forth swinging movements and vertical shogging movements between the front and back needles 6, 7 so as to lap the knitting yarns 9, 9*a* over the respective needles 6, 7 in response to the respective vertical movements of the front and back needles 6, 7. In the illustrated example, in a section of the back needle 6 where no corresponding front needles 7 are arranged, the knitting yarn guides 8 are moved so as to lap the foundation-structure knitting yarns 9 over only the back needles 6. By the lapping movements of the knitting yarn guides 8 and the vertical movements of the needles 6, 7, the knitting yarns 9 are introduced to the corresponding needles 6, 7 to form the respective stitches.

Further, in this embodiment, the monofilament carrier 3 which constitute the main member of this invention as a monofilament bending means, is disposed between the front side (the side toward you in FIG. 1) of the second needle bed 2 and the side of the front needles 7. This monofilament carrier 3 is in the form of an L-shaped lever having in its free end a monofilament guide opening 3*a* through which the monofilament 5 made of synthetic resin and having a substantially oval cross section is inserted. As the monofilament carrier 3 reciprocates, the monofilament 5 is bent at a succession of predetermined bending portions thereof one after another to form the continuous fastener element row 10. An base end of the carrier 3 is connected with a single drive source 15 via a synchronous transmission mechanism such as a cam as shown in FIG. 3, and the monofilament guide opening 3*a* reciprocates in an upper space between the first and second needle beds 1, 2 along a longitudinal direction thereof. Alternatively, the monofilament 5 to be inserted through the monofilament carrier 3 may be a synthetic resin monofilament having a substantially circular cross section and longitudinally spaced successive flattened portions, which are previously formed by pressing to facilitate forming head portions 5*a*, upper and lower leg portions 5*b*, and connecting portions 5*c*.

The reciprocating movement of the monofilament carrier 3, with the monofilament 5 inserted through the guide opening 3*c*, takes place at an underlapping position of the back needles 6 when the back needles 6 and the front needles 7 are in an raised position and in an lower position, respectively, thus bending the monofilament 5 to continuously form a coiled fastener element row 10. At that time, in order to maintain the bent shape of the monofilament 5 and each of the bent positions at the head portions 5*a*, a tip of the hook-shaped head-portion-holding member 4 is moved toward and away from the inner side of the head portion 5*a* of the monofilament 5 for holding each of the head portion 5*a* from its inner side thereof.

Since upper and lower legs portions 5*b* of the preceding fastener element are already anchored as knitted in the fastener tape T, it is unnecessary to positively define the bent position of the connecting portion 5*c*. The head-portion-holding member 4 is operatively connected to the single drive source 15 via a synchronous transmission mechanism 16 such as a cam, as shown in FIG. 3, for reciprocating movement.

In the illustrated example, the needles 6, 7, the knitting guides 8, the monofilament carrier 3 and the head-potion-holding member 4 are connected to the single drive source 15 via the respective synchronous transmission mechanisms 16 such as rotary cams, as shown in FIG. 3, for movements in timed relation to one another. Alternatively, these individual members may be connected to a plurality of drive sources. In another alternative form, the individual members may be operated individually according to a program preset in a non-illustrated central control unit such as a computer instead of synchronous transmission mechanisms.

The process of manufacturing a knit slide fastener stringer on the apparatus of the first embodiment will now be described in detail based on the forming and knitting of the fastener element row 10 of FIGS. 1 and 2. In this process, for example, a knit slide fastener stringer having a warp-knit fastener tape shown in FIG. 4 is manufactured.

As shown in FIG. 4, the foundation structure of the fastener tape T including the fastener-element attaching margin T1 and the web portion T2 is composed of chain-stitch yarns 11 forming a multiplicity of parallel longitudinal wales, tricot-stitch yarns 12 knit in the foundation structure and each extending between the adjacent wales, and weft-inlaid yarns 13 laid in a zigzag pattern in the foundation structure and each extending across four wales. Alternatively each weft-inlaid yarn 13 may extend in a zigzag pattern across two or three wales rather than four wales. Therefore, the weft-inlaid yarns 13 need not to be laid in a uniform pattern, but may be laid in a zigzag pattern, for example, extending two or four wales in on the fastener-element-attaching margin T1.

Outermost four wales of the fastener tape T constitute a fastener-element attaching margin T1 in which three wales of chain stitches except the outermost wale are knit with a double chain-stitch structure composed of anchoring knitting yarns 11*a*. Specifically, in this embodiment, the anchoring knitting yarns 11*a* are knit in double chain stitch with closed stitches on a side of the back needles 6 and with open stitches on a side of the front needles 7, so as to press the upper and lower leg portions 5*b* of a single fastener element of the fastener element row 10 against the foundation structure by every other chain-stitch needle loop, which is formed by the front needle 7.

More specifically, the front needles 7 form stitches of one side of the double chain-stitch structure over the fastener element row 10 to be knitted therein, and each of their needle loops is interlooped with its succeeding needle loop of the same anchoring chain stitch yarns 11*a*, which is formed next along the wale. By repeating this procedure, a succession of chain stitches is formed longitudinally over and along the fastener element row 10. On the other hand, the back needles 6 form the entire foundation structure of the fastener tape T including the fastener-element attaching margin T1. Namely, the back needles 6 knit both the web portion T2, which is composed of chain-stitch yarns 11, tricot-stitch yarns 12 and weft-inlaid yarns 13, and the fastener-element attaching margin T1, which is composed of three anchoring chain-stitch yarns 11*a* and a single chain-stitch yarn 11 forming the needle loops on the other side.

Thus, in the fastener-element attaching margin T1, the anchoring chain stitches on one side and those on the other side are formed in a double layer between the adjacent leg portions of the fastener element row 10 by the front and back needles 7, 6, respectively. And the tricot-stitch yarns 12 and the weft-inlaid yarns 13 are interlaced with the anchoring chain stitches formed on the other side by the back needles 6. The resulting fastener-element margin T1 has a very high dense knit structure and is hence stable in shape.

On the other hand, on the front side, adjacent wales of the anchoring chain stitches or two wales of the anchoring chain stitches may be connected by anchoring tricot stitches toward the connecting portions 5*c* of the fastener element 10. The size and the number of the anchoring knitting yarns are decided according to the kind and application of the slide fastener and should not be limited. The stitches are shown in a loosened posture in FIG. 4 only for better understanding of the knit structure; however, the real stitches are much tighter.

As is understood from the foregoing knit structure, according to the apparatus of this embodiment, partly since the fastener elements are knitted in and anchored to the fastener tape T by forming a single stitch over each fastener element by the front needle 7 and partly since a single chain stitch is then formed between the fastener element and its succeeding adjacent fastener element by the front needle 7, individual fastener elements are spaced at a uniform distance to secure the original function of a slide fastener. Such forming two stitches is regarded as a single cycle, during which the back and front needles 6, 7 are alternately moved up and down twice respectively, and the transmission mechanisms also take two actions.

The timing of movement of the individual members during this single-cycle knitting will now be described in detail with reference to FIGS. 1 and 2.

(a) With the front needles 7 in the lower limit position, the back needles 6 start moving upward to the upper limit position, whereupon the back needles 6 stay there for a predetermined time. At the same time, the knitting yarn guides 8 are moved to overlap the knitting yarns 9, 9*a* to the back needles 6, at which time the monofilament carrier 3 is in a standby position (FIG. 2).

(b) Then the back needles 6 are lowered to form stitches of the foundation structure of the fastener tape T, during which the monofilament carrier 3 starts reciprocating the monofilament 5 between the back needles 6 and the front needles 7.

(c) Upon completion of lowering of the back needles 6, the front needles 7 start moving upward, during which the monofilament carrier 3 arrives at its upper limit position, and at the same time, the head-portion-holding member 4 moves to a folded portion of the head portion 5*a* of the monofilament 5 and stays there (FIG. 1). Then the monofilament carrier 3 returns to the standby position, bending the head portion 5*a* of the monofilament 5 at its center, thus forming a single fastener element.

(d) Upon arrival of the front needles 7 at its upper limit position with their continued upward movement (FIG. 1), the individual knitting yarn guides 8 take vertical swinging movement from a side of the back needles 6 toward a side of the front needles 7 and horizontal shogging movement to overlap the individual anchoring knitting yarns 9*a* to the corresponding front needles 7.

As the result of swinging and shogging of the knitting yarn guides 8, the anchoring knitting yarns 9*a* cross forwardly (on the side toward you in FIG. 1) over the upper and lower leg portions 5*b* of the fastener element previously formed by the reciprocating movement of the monofilament carrier 3.

(e) Then the front needles 7 are lowered to form stitches over the fastener element (on the side toward you in FIG. 2), thereby anchoring the fastener element row 10 to the fastener tape T. The head-portion-holding member 4 is then retracted from the head portion 5*a* to such a position as not to interfere with other members (the phantom-line position in FIG. 1).

(f) Upon completion of lowering of the front needles 7 and while the front needles 7 stay its lower limit position, the back needles 6 start moving upward. Upon completion of upward movement of the back needles 6, the knitting yarn guides 8 take swinging movement from the side of the front needles 7 to the side of the back needles 6 and horizontal shogging movement to overlap the knitting yarns to the back needles 6. Then the back needles 6 are lowered to knit the foundation structure of the anchoring chain stitches for anchoring the fastener element row 10 of the fastener-element attaching margin T1.

(g) Upon completion of lowering of the back needles 6, the front needles 7 move upward. Upon completion of the upward movement of the front needles 7, the knitting yarn guides 8 take swinging movement from the side of the back needles 6 to the side of the front needles 7 and horizontal shogging movement to overlap the knitting yarns to the front needles 7. At that time, the monofilament carrier 3 is in the standby position so that the bending of the monofilament 5 does not take place.

(h) Then the front needles 7 are lowered to form a single stitch between a preceding fastener element and a succeeding fastener element that has not yet been formed.

Thus the back needles 6 arranged in a range devoid of any confronting front needles form the foundation structure of both the web portion T2 and the fastener-element attaching margin T1 while forming two stitches for the above-mentioned single cycle.

The foregoing procedures (a)–(h), which constitute a single cycle of operation, are then repeated to knit the continuous fastener element row 10 in the attaching margin T1 of the fastener tape T simultaneously with the knitting of the fastener tape T while the monofilament 5 is intermittently bent to form the coiled fastener elements.

As is understood from the foregoing description of operation of the individual members, in the apparatus of this invention, since the monofilament carrier 3 operates between the back needles 6 and the front needles 7 with either the front needles 7 or the back needles 6 being in the lower limit position, it is easy to keep a large locus of the monofilament carrier 3 so that the movement of the carrier 3 is free from any obstruction.

FIG. 5 shows a second embodiment of the invention. The second embodiment is identical with the first embodiment except that the L-shaped monofilament carrier 3, as the monofilament bending means, is substituted by a tubular guide 30 so that the head-portion-holding member 4 can be disposed below the head-portion-forming position to effectively avoid interference with other members and the knitting yarns.

Figure 6:
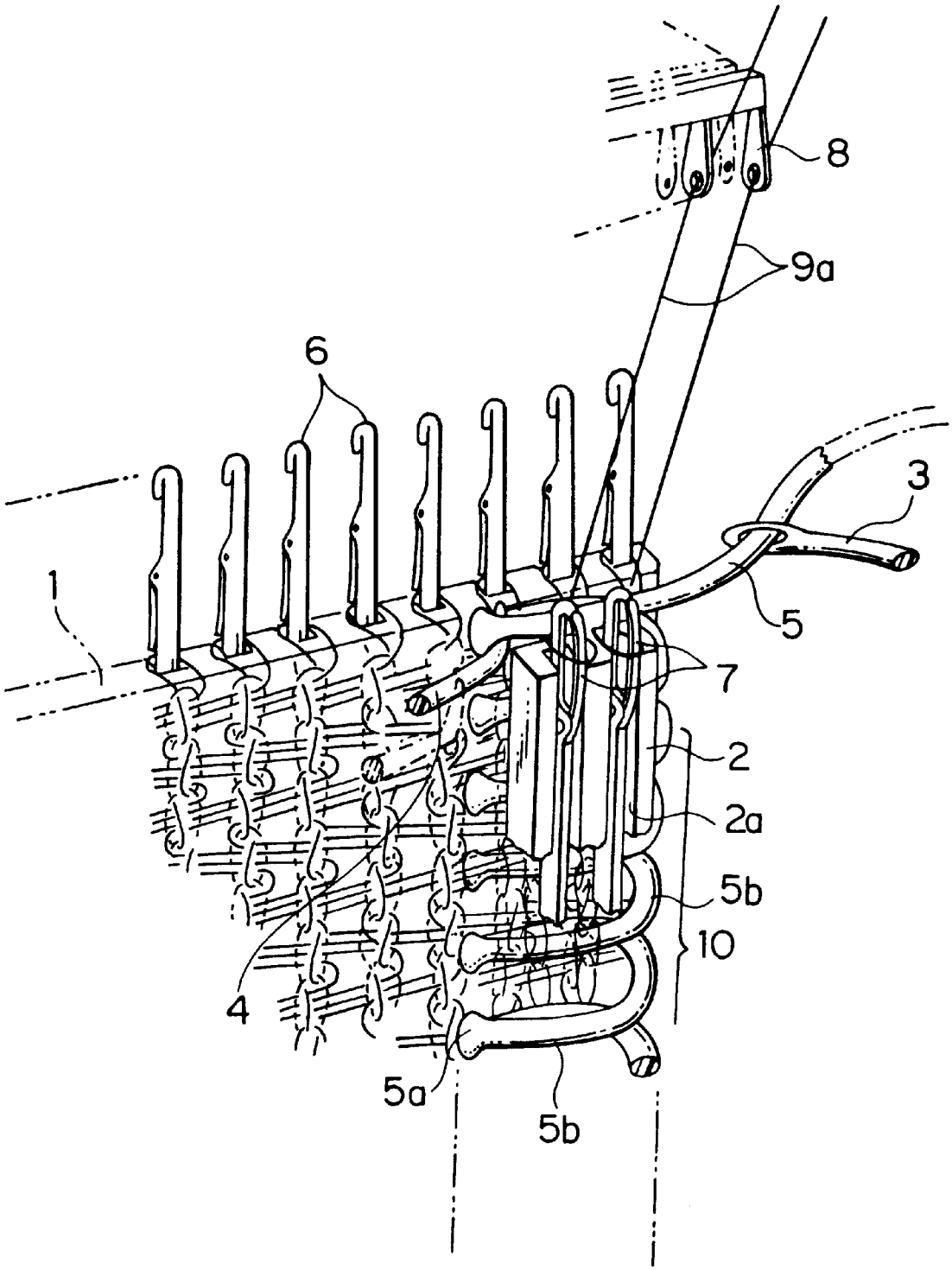
FIG. 6 is a perspective view showing a knit slide fastener stringer manufacturing apparatus according to a third embodiment of this invention.

FIG. 6 shows an apparatus according a third embodiment of the invention of which apparatus is for manufacturing a concealed knit slide fastener stringer to be used in such a posture that a fastener-element attaching margin T1 of a fastener tape T with a fastener element row 10 knitted therein is turned over a web portion T2. This embodiment is identical with the second embodiment except that the second needle bed 2 is in the form of a narrow plate having a reduced width only enough to cover a predetermined number of sliding grooves 2*a* corresponding to a necessary number of anchoring knitting yarns 12*a*. With this arrangement, a large space is defined on a back side of the first needle bed 1 where no front needle exists. The head-portion-holding member 4 is movable within this space, and the position for forming each head portion 5*a* of the fastener element 10 is disposed on the side of the web portion T2 of the fastener tape T. Due to the above-mentioned position of the head-portion-holding member 4, a non-illustrated drive unit for driving the carrier 3 as the monofilament bending means is disposed outside the first and second needle beds 1, 2.

According to the third embodiment, the monofilament carrier 3 takes reciprocating movement from outside of the first and second needle beds 1, 2 so as to form head portions 5*a* along the border of the fastener-element attaching margin T1 and the web portion T2. Other knitting actions are substantially similar to the ones of the foregoing embodiments. The fastener tape T of this knit slide fastener stringer is folded along the fastener element row 10 about a folding line near the connecting portions 5*c*, and then the folded fastener stringer is heated to heat-set the fastener element row 10. As a result, the knit slide fastener stringer for concealed slide fasteners is manufactured.

In any of the foregoing embodiments, the anchoring stitches for knitting in and anchoring the fastener element row 10 to the fastener tape T are formed on the side of the front needles 7. Alternatively, the foundation structure of the fastener tape T may be knitted on the side of the front needles 7, while the anchoring stitches may be formed on the side of the back needles 6. The foundation knit structure and the anchoring knit structure should by no means be limited to the illustrated embodiments. Further, the continuous fastener element row to be formed by bending the monofilament should not be limited to the above-mentioned coiled type. Alternatively, the fastener element row knitted in the fastener tape may be a zigzag type, in which U bents are successively and alternately arranged on a plane along the fastener tape T. In this case, the fastener element row is obtained by changing the operation timing of the reciprocating movement of the monofilament bending means and the head-portion-holding movement of the head-portion-holding member.

As is apparent from the foregoing description, according to the method and apparatus of this invention, by adding a slight improvement to, for example, a conventional double Raschel knitting machine, it is possible to efficiently manufacture a warp-knit slide fastener stringer having a desired knit structure with a fastener element 10 knitted therein. Further, since a return locus of the monofilament bending means 3, which constitutes a characterizing feature of the invention, is positioned in an upper space between the first and second needle beds 1, 2, and since the reciprocating movement of the bending means 4 is made at an underlapping position of raised needles that are arranged in one of the needle beds 1, 2 for knitting a foundation knit structure, when the raised needles are at their upper most position while needles in the other needle bed for forming anchoring stitches are at their lower most position, it is possible to avoid any interferece with other knitting members and the knitting yarns, it is possible to bend the monofilament accurately at a desired timing and in a stable shape.

Furthermore, if the head-portion-holding member 4 for holding a possible head portion, of the monofilament from its inner side during bending, is provided in addition to the monofilament bending means, it is possible to secure a stable shape of the bent shape of the elements and to position the head portions of the fastener element row accurately.

What is claimed is:

1. A method of manufacturing a knit slide fastener stringer having a slide fastener element row which is continuously knitted in and along one longitudinal edge of a warp-knit fastener tape simultaneously with the knitting of the fastener tape while the slide fastener element row is formed by bending a linear synthetic resin monofilament, said method comprising the steps of:

(a) sliding a multiplicity of parallel knitting needles vertically in a first needle bed;

(b) sliding one or more knitting needles vertically in a second needle bed disposed along one end portion of said first needle bed in a back-to-back relationship, with a predetermined distance from said first needle bed;

(c) swinging and shogging a number of knitting yarn guides with respect to the corresponding needles of said first and second needle beds;

(d) providing the linear synthetic resin monofilament for forming the slide fastener element row to a monofilament bending means;

(e) reciprocating the monofilament bending means, which is disposed near one end of said first needle bed, in an upper space between said first and second needle beds longitudinally along said first and second needle beds; and (f) driving said needles, said knitting yarn guides and said monofilament bending means by a driving means at a predetermined timing in synchronism with one another, wherein said monofilament bending means reciprocates between said needles of said first and second needle beds at an underlapping position to continuously form individual slide fastener elements while bending the monofilament and also to knit the slide fastener elements in the fastener tape by the back-to-back needles of the first and second needle beds simultaneously with the knitting of the fastener tape.

2. A method according to claim 1, further including moving a head-portion-holding member between a head-portion-holding position and a non-head-portion-holding position in synchronism with the bending of the monofilament.

3. A method according to claim 1, wherein said monofilament bending means takes a single reciprocating movement when said needles in said second needle bed are moved upwardly.

4. A method according to claim 3, wherein said monofilament bending means takes the reciprocating movement for the stitches of every other course of the fastener tape.

5. A method according to any of claims 1–4, wherein said head-portion-holding position is disposed at an outer end portion of said second needle bed so that the head portions of the individual fastener elements may be formed along an outer edge of a fastener element attaching margin.

6. A method according to any of claims 1–4, wherein said head-portion-holding position is disposed at a position inside said second needle bed so that the head portions of the individual fastener elements may be formed along an inner edge of a fastener-element attaching margin of the fastener tape at a border with a web portion.

7. A method according to claim 5, wherein said monofilament bending means is retracted to a terminal position of said single reciprocating movement not to interfere with the knitting yarns.

8. An apparatus for manufacturing a knit slide fastener stringer having a slide fastener element row which is continuously knitted in and along one longitudinal edge of a warp-knit fastener tape simultaneously with the knitting of the warp-knit fastener tape while the slide fastener element row is formed by bending a linear synthetic resin monofilament, said apparatus comprising:

(a) a first needle bed slidably guiding a multiplicity of parallel knitting needles vertically;

(b) a second needle bed disposed along one end portion of said first needle bed in a back-to-back relationship, with a predetermined distance from said first needle bed slidably guiding one or more knitting needles;

(c) a number of knitting yarn guides moveable with respect to the corresponding needles of said first and second needle beds;

(d) a monofilament bender disposed at a position near one end of said first needle bed and having a reciprocating movement in an upper space between said first and second needle beds longitudinally along said first and second needle beds; and (e) a driver connect to and synchronously driving said needles, the knitting yarn guides and said monofilament bender at a predetermined timing, in which said monofilament bender reciprocates between said needles at an underlapping position to continuously form individual slide fastener elements by bending the monofilament and also to knit the slide fastener elements in the fastener tape by the back-to-back needles of the first and second needle beds simultaneously with the knitting of the fastener tape.

9. An apparatus according to claim 8, further including a head-portion-holding member adapted to be moved between a head-portion-holding position and a non-head-portion-holding position in synchronism with the bending of the monofilament.

10. An apparatus according to claim 8, wherein said monofilament bender takes a single reciprocating movement when said needles in said second needle bed are moved upwardly.

11. An apparatus according to claim 10, wherein said monofilament bender takes the reciprocating movement for the stitches of every other course of the fastener tape.

12. An apparatus according to any of claims 8–11, wherein said monofilament bender is retracted to a terminal position of said single reciprocating movement not to interfere with the knitting yarns.

13. An apparatus according to any of claims 9–11, wherein said head-portion-holding member is disposed at an outer end portion of said second needle bed so that the head portions of the individual fastener elements may be formed along an outer edge of a fastener element attaching margin.

14. An apparatus according to any of claims 9–11, wherein said head-portion-holding member is disposed at a position inside said second needle bed so that the head portions of the individual fastener elements may be formed along an inner edge of a fastener-element attaching margin of the fastener tape at a border with a web portion.

15. A method according to claim 2, wherein said monofilament bending means takes a single reciprocating movement when said needles in said second needle bed are moved upwardly.

16. A method according to claim 6, wherein said monofilament bending means is retracted to a terminal position of said single reciprocating movement not to interfere with the knitting yarns.

17. An apparatus according to claim 9, wherein said monofilament bender takes a single reciprocating movement when said needles in said second needle bed are moved upwardly.

18. An apparatus according to claim 12, wherein said head-portion-holding member is disposed at an outer end portion of said second needle bed so that the head portions of the individual fastener elements may be formed along an outer edge of a fastener element attaching margin.

19. An apparatus according to claim 12, wherein said head-portion-holding member is disposed at a position inside said second needle bed so that the head portions of the individual fastener elements may be formed along an inner edge of a fastener-element attaching margin of the fastener tape at a border with a web portion.

20. An apparatus according to claim 17, wherein said monofilament bender takes the reciprocating movement for the stitches of every other course of the fastener tape.

* * * * *